US008529292B2

(12) United States Patent
Aihara

(10) Patent No.: US 8,529,292 B2
(45) Date of Patent: Sep. 10, 2013

(54) BOARD CONNECTOR HAVING A HOUSING WITH A MOUNTING GROOVE WITH UPWARDLY FACING SURFACES FOR RECEIVING PROJECTING LOCKS OF A MOUNTING FIXTURE

(75) Inventor: Tetsuya Aihara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/278,257

(22) Filed: Oct. 21, 2011

(65) Prior Publication Data

US 2012/0122347 A1 May 17, 2012

(30) Foreign Application Priority Data

Nov. 11, 2010 (JP) ..... 2010-253083

(51) Int. Cl.
*H01R 13/73* (2006.01)

(52) U.S. Cl.
USPC ..... 439/565

(58) Field of Classification Search
USPC ..... 439/570, 566, 571–575, 565
See application file for complete search history.

(56) References Cited

U.S. PATENT DOCUMENTS 5,232,379 A * 8/1993 Lai ..... 439/570
5,551,891 A * 9/1996 Huss, Jr. ..... 439/567
6,270,377 B1 8/2001 Miyazaki et al.
6,471,544 B1 * 10/2002 Huang ..... 439/567
7,048,576 B2 * 5/2006 Nakano ..... 439/570
7,052,317 B2 * 5/2006 Hara et al. ..... 439/567
7,134,886 B2 * 11/2006 Okamura et al. ..... 439/79
7,134,910 B2 11/2006 Nakano et al.
7,347,725 B2 * 3/2008 Sakamoto ..... 439/566
7,458,848 B2 * 12/2008 Nakano ..... 439/570
7,467,956 B2 * 12/2008 Hirai et al. ..... 439/83
7,488,208 B2 * 2/2009 Takahashi et al. ..... 439/570
7,581,985 B2 * 9/2009 Sakamoto ..... 439/566
7,806,702 B2 * 10/2010 Aihara et al. ..... 439/79
7,828,608 B2 * 11/2010 Aihara et al. ..... 439/752
2002/0081900 A1 * 6/2002 Yu et al. ..... 439/567
2009/0035993 A1 2/2009 Okayasu

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A board connector includes a housing (20) into which a mating connector (50) is to be fit, mounting grooves (30) formed on side surfaces of the housing (20), and metal fixing fixtures (40) to be mounted into the mounting grooves (30) while the plate surfaces thereof move along the side surfaces of the housing (20) and lower ends of which are to be fixed to a board (P). Projecting locks (43, 45) project laterally along the plate surface and a bent lock (44) bent outward substantially at a right angle with respect to the plate surface are arranged vertically one above another on each lateral edge of each fixing fixture (40). On the other hand, each mounting groove (30) includes receiving surfaces (35, 36, 38) that respectively contact with the projecting locks (43, 45) and the bent locks (44) to prevent downward movements of the locks.

6 Claims, 11 Drawing Sheets

BOARD CONNECTOR HAVING A HOUSING WITH A MOUNTING GROOVE WITH UPWARDLY FACING SURFACES FOR RECEIVING PROJECTING LOCKS OF A MOUNTING FIXTURE

BACKGROUND OF THE INVENTION

1. Field of the Invention

The invention relates to a board connector.

2. Description of the Related Art

U.S. Pat. No. 7,134,910 discloses a board connector with a synthetic resin housing configured to receive a mating connector from the front. Mounting grooves are formed on side surfaces of the housing. Fixtures are mounted in mounting grooves and lower end portions of the fixtures are fixed to a circuit board by soldering. More specifically, the fixtures are formed by press-working a metal plate. Locks are formed at upper end portions of each fixture and project laterally from the opposite lateral edges. On the other hand, the mounting grooves each are formed to have a stepped shape with a widened upper end. The fixture is inserted into the mounting groove from above along the side surface of the housing, and a part of the fixture below the locks is pushed and press-fit into a narrow part of the mounting groove. This pushing operation is stopped when the locks contact step surfaces of the mounting groove. In this way, the fixtures are mounted while downward movements with respect to the housing are prevented. Thus, when the fixtures are fixed to the circuit board, the step surfaces of the mounting grooves are engaged with the locks of the fixtures to prevent upward detachment of the housing.

The above-described board connector is mounted on the circuit board and used with a mating connector that is fit in the housing. A wiring harness pulled vertically out from the mating connector may move due to vibration or the like and the wiring harness could be pulled up during use. Thus, a force acts to tear the housing from the circuit board and the front step surfaces formed in the mounting grooves are mainly engaged with the front locks on the fixtures to prevent the housing from being torn from the circuit board.

On the other hand, there is a tendency to thin the fixtures for weight saving and the like. If a large force acts on the housing in a direction to tear the housing, the locking portions may be deformed and bent so that engagement areas with the step surfaces are reduced. Therefore, the locks may disengage from the step surfaces and the synthetic resin step surfaces may be scraped away.

The invention was developed in view of the above situation and an object thereof is to increase fixing strength of a board connector to a board.

SUMMARY OF THE INVENTION

The invention relates to a board connector, comprising: a housing into which a mating connector can be fit from the front. At least one mounting groove is formed on at least one side surface of the housing. The board connector also has at least one fixture that can be mounted into the mounting groove along an inserting direction. The fixture has a plate surface that moves substantially along the side surface of the housing and a distal end portion that is to be fixed to a board. At least one projecting lock projects laterally substantially along the plate surface and at least one bent lock is bent out at an angle with respect to the plate surface. The projecting lock and the bent lock are arranged one above the other along the inserting direction on a lateral edge of the fixing fixture. The mounting groove includes receiving surfaces that contact the projecting lock and the bent lock to prevent further insertion of the locks.

The fixture preferably is made of a metal plate material.

The fixture is mounted in the mounting groove with the projecting lock and the bent lock held in contact with the corresponding receiving surfaces. The receiving surfaces are engaged with the corresponding locks to prevent upward detachment of the housing when the fixture is fixed to the board. The two locks enable a load acting on the locks to be distributed, thereby preventing deformation of the locks and assuring a locking function.

The fixture would become wider if the two locks one above the other both were projecting. Accordingly, the width of the mounting groove and, therefore, the depth of the housing would be increased. However, one lock of the fixture of the invention is bent to suppress the width enlargement of the fixture and the mounting groove. Therefore, the bent lock avoids the need to enlarge the housing. As a result, fixing strength of the board connector to the board is increased without enlarging the housing.

The projecting lock may be above (or behind as seen in the inserting direction) the bent lock. Thus, a large engagement area of the projecting lock with the receiving surface is ensured while the outer surface of the bent lock is held in contact with the groove bottom of the mounting groove as not to shake.

At least one reinforcing bead may be provided on the fixture. The reinforcing bead may extend in a direction intersecting the inserting direction and may be at a height position of the fixture substantially corresponding to a formation position of the bent lock. The reinforcing bead may be horizontal. The reinforcing bead increases rigidity of a bent part of the bent lock and reliably prevents deformation of the bent lock.

At least one mounting plate may be provided at a distal end portion of the fixing fixture and may be bent out at an angle, preferably substantially a right angle, with respect to the plate surface. The mounting is to be fixed to the board preferably by soldering.

These and other objects, features and advantages of the invention will become more apparent upon reading the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
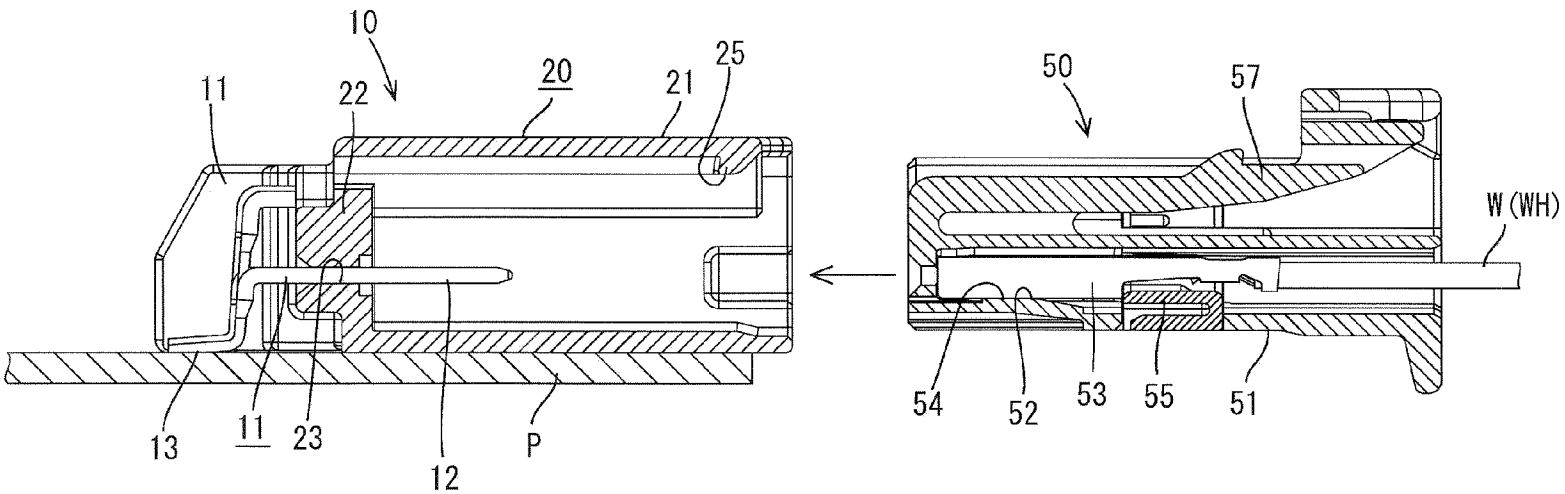
FIG. 1 is a side view in section showing an operation of connecting a harness-side connector to a board connector according to one embodiment of the invention.

A board connector in accordance with the invention is identified by the numeral 10 in FIG. 1. The board connector 10 is to be fixed or mounted to an end part of an electric device or a board. such as a printed circuit board P and a harness-side connector 50 connected to an end of a wiring harness WH is connected to the board connector 10 from the front.

The board connector 10 includes a housing 20 made e.g. of synthetic resin and having terminal fittings 11 accommodated therein. Two fixtures 40 are mounted on opposite side surfaces of the housing 20 and are fixed to the board P by soldering, bolting, gluing or the like.

Figure 2:
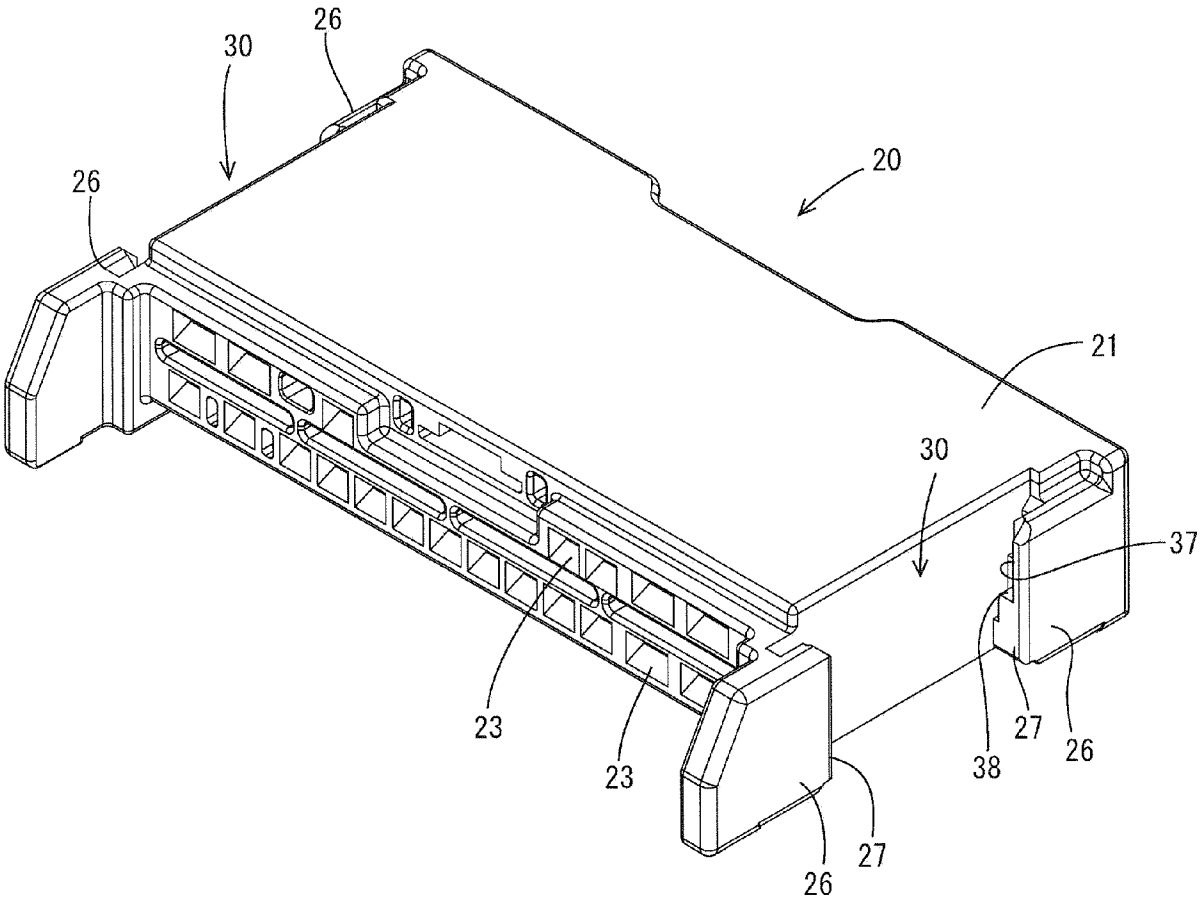
FIG. 2 is a perspective view of a housing of the board connector.

As also shown in FIG. 2, the housing 20 is substantially is in the form of a wide block and a receptacle 21 is formed at its front end for receiving the housing-side connector 50. Terminal insertion holes 23 are formed in upper and lower stages in a base wall 22 of the housing 20 at the back of the receptacle 21. Terminal connecting portions 12 at one ends of the terminal fittings 11 are inserted into the respective terminal insertion holes 23 and project in an array into the receptacle 21.

The other end of each terminal fitting 11 projects back from the base wall 22 and is bent down at a substantially right angle at a specified position, and a lower end portion that reaches the lower surface of the housing 20 is bent further back at a substantially right angle to define a board connecting portion 13. The board connecting portion 13 of each terminal fitting 11 is soldered or otherwise connected to a corresponding conductive path on the board P when the housing 20 is placed at a specified position on the board P.

Figure 7:
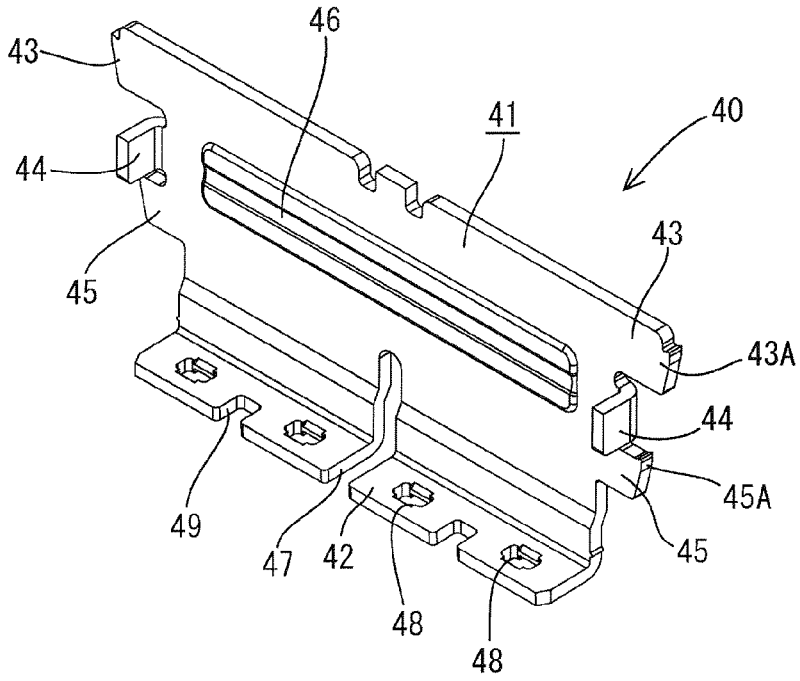
FIG. 7 is a perspective view of the fixture.
Figure 8:
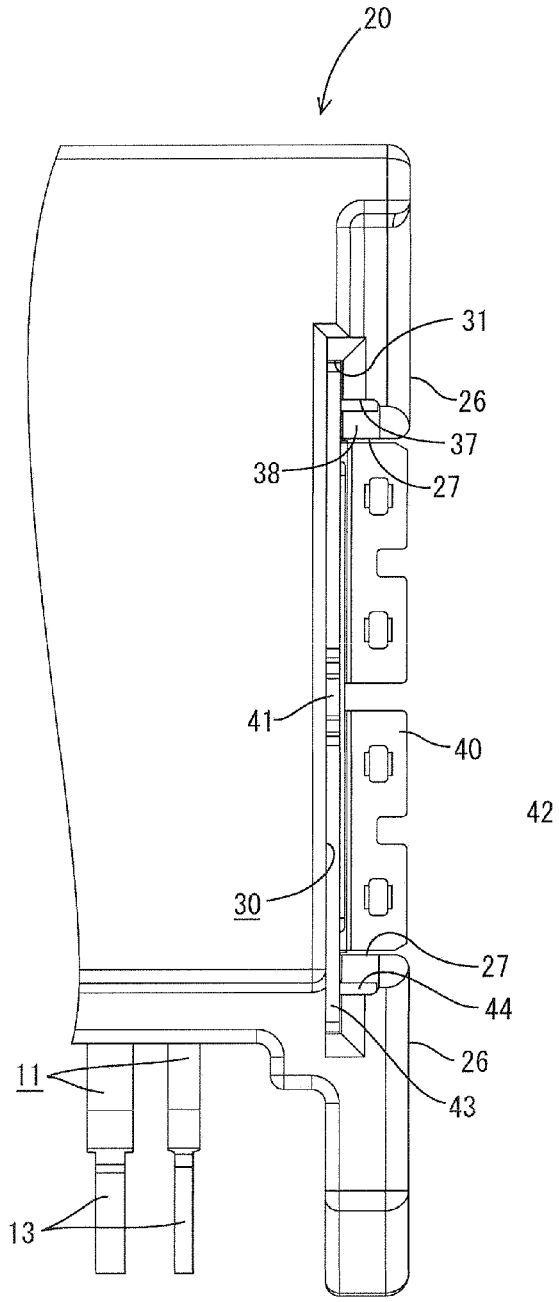
FIG. 8 is a partial plan view showing a state where the fixture is mounted in the mounting groove of the housing.

Each fixture 40 is formed by press-working a metal plate and includes a main plate 41 to be mounted on the side surface of the housing 20 and a mounting plate 42 bent out at a substantially right angle from the lower end of the main plate 41 and is to be placed on the board P. Thus, the fixture 40 is substantially L-shaped, as shown in FIGS. 3, 4 and 7.

Figure 3:
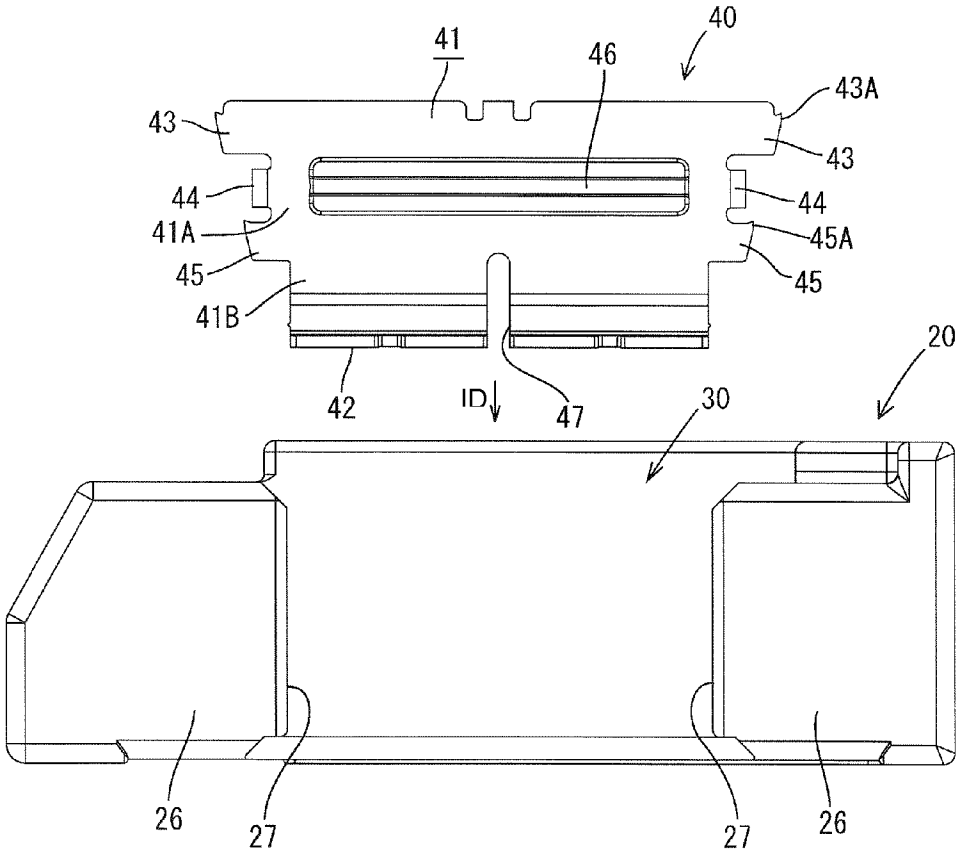
FIG. 3 is a side view showing an operation of inserting a fixture into a mounting groove of the housing.
Figure 4:
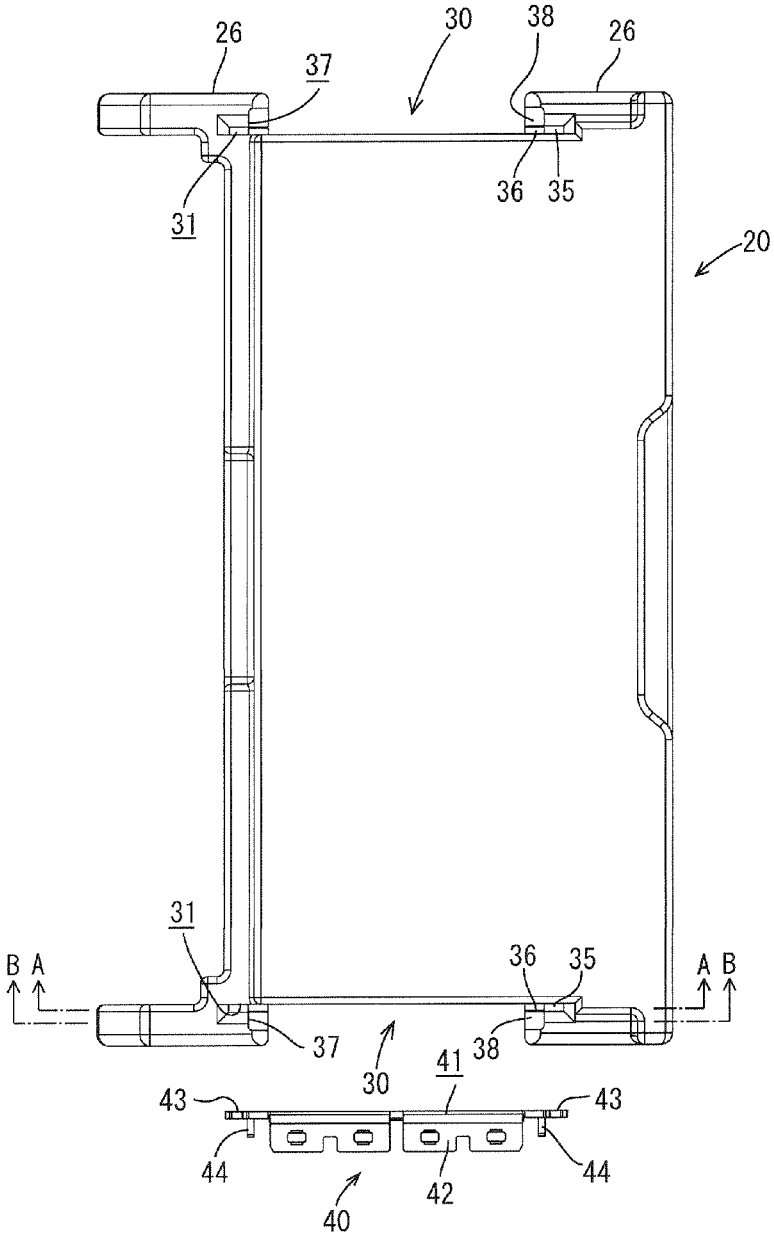
FIG. 4 is a plan view of the housing and the fixture.

As shown in FIG. 3, the main plate 41 has a stepped shape with a wide upper portion 41A and a narrow lower portion 41B. Note that a lower area of the narrow portion 41B has a stepped shape by bulging out by a distance that is about half the thickness.

Three locks 43, 44 and 45 are formed on each of the opposite left and right edges of the wide portion 41A of the main plate 41 while being spaced apart in a vertical direction and being substantially bilaterally symmetrical.

First projecting locks 43 are formed at an upper end position and project laterally a relatively long distance to substantially extend along the plate surface of the main plate 41. Biting projections 43A are formed on the projecting edges of the first projecting locks 43.

Bent locks 44 are formed at an intermediate or center position in a height direction and are bent out at substantially right angles with respect to the plate surface of the main plate 41.

Second projecting locks 45 are formed at a lower end position and project out laterally a relatively short distance along the plate surface of the main plate 41. The positions of the projecting edges of the second projecting locks 45 are equivalent to those of the outer surfaces of the bent locks 44, and biting projections 45A are formed on these projecting edges.

At least one substantially horizontal reinforcing bead 46 is formed substantially over the entire width at a height position of the wide portion 41A of the main plate 41 substantially corresponding to formation positions of the bent locks 44.

A slit 47 is formed at a widthwise center position in an area extending from the mounting plate 42 to the narrow portion 41B of the main plate 41 of each fixture 40, and two solder insertion holes 48 are formed in each divided part of the mounting plate 42 and a solder insertion groove 49 is formed in the projecting edge of each divided part.

Mounting grooves 30 are formed on the opposite side surfaces of the housing 20 as shown in FIGS. 2 to 4, and the respective fixtures 40 are insertable therein from above. Thus, front and rear walls 26 bulge out on each of the opposite side surfaces of the housing 20. Both walls 26 have a height longer than the entire length of the fixture 40 and a width that is several times (particularly more than about twice, more specifically more than about three times, e.g. about seven times) as large as the thickness of the fixture 40, and vertical surfaces 27 thereof substantially facing each other are spaced apart by a distance substantially equal to the width of the narrow portion 41B of the main plate 41 of the fixture 40.

Figure 5:
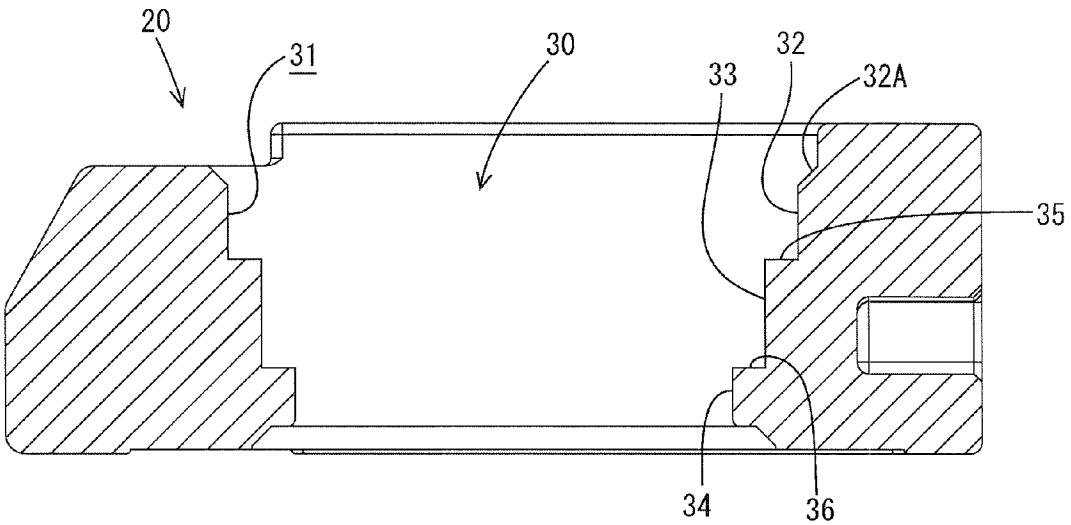
FIG. 5 is a section along A-A of FIG. 4.
Figure 6:
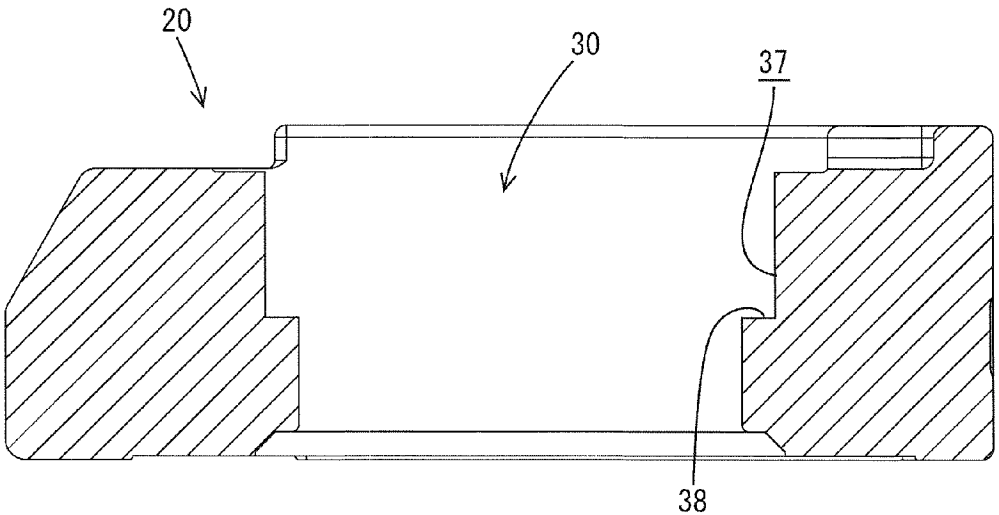
FIG. 6 is a section along B-B of FIG. 4.
Figure 9:
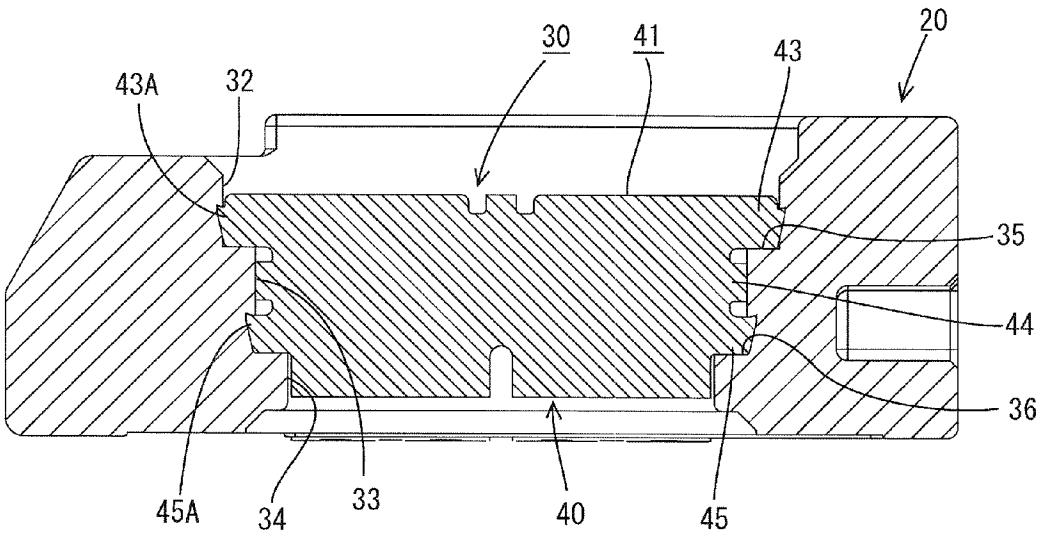
FIG. 9 is a section along A-A of FIG. 4 showing a state where the fixture is mounted.

The above mounting groove 30 is formed between the facing surfaces 27 of the walls 26. Specifically, a back side groove 31, into which the main plate 41 of the fixture 40 is closely insertable or fittable, is formed at a back side position on the side surface of the housing 20 between the facing surfaces 27 of the both walls 26. As shown in FIGS. 5 and 9, the back side groove 31 has a stepped shape that narrows toward a bottom side in a stepped manner to have at least three stages. An upper stage 32 has a width to closely accommodate the bulging edges of the first projecting locks 43, an intermediate stage 33 has a width to accommodate the projecting edges of the second projecting locks 45 and the outer surfaces of the both bent locking portions 44 and a lower stage 34 has a width to substantially equal to the spacing between the facing surfaces 27 and slightly longer than the width of the narrow portion 41B of the main plate 41.

The groove bottoms of upper sides of the upper stage 32 define tapered surfaces 32A to widen the upper stage 32 toward the top for a guiding purpose.

Steps between the upper stage 32 and the intermediate stage 33 in the back side groove 31 define first receiving surfaces 35 for receiving the lower surfaces of the first projecting locks 43, and steps between the intermediate stage 33 and the lower stage 34 define second receiving surfaces 36 for receiving the lower surfaces of the second projecting locks 45.

A groove 37 is formed at a side before the back side groove 31 between the facing surfaces 27 of the walls 26 and communicates with the back side groove 31 to allow insertion of the bent locks 44 of the fixture 40. The groove bottoms (side surfaces) of the vertical groove 37 are substantially flush with the groove bottoms (side surfaces) of the intermediate stage 33 of the back side groove 31 and are formed from the upper surfaces substantially to a position slightly lower than central height positions of the facing surfaces 27. The bottom surfaces of this vertical groove 37 define third receiving surfaces 38 for receiving the lower surfaces of the bent locks 44. These third receiving surfaces 38 are at a specified distance from the second receiving surfaces 36 of the back side groove 31.

The fixture 40 is to be inserted into the mounting groove 30 from above and along an inserting direction ID as shown by an arrow of FIG. 3. Although described in detail later, the first and second projecting locks 43 and 45 at the lateral edges of the main plate 41 are press-fit respectively into the upper and intermediate stages 32 and 33 of the back side groove 31, and the bent locks 44 are pushed while being inserted into the vertical groove 37. The first and second projecting locks 43, 45 respectively contact the first and second receiving surfaces 35, 36 of the back side groove 31 and the bent locks 44 contact the third receiving surfaces 38 at the bottom of the vertical groove 37 when the mounting plate 42 is pushed to a position slightly above the lower surface of the housing 20, thereby preventing any further pushing movement of the fixing fixture 40.

As shown in FIG. 1, the housing-side connector 50 has a synthetic resin housing 51 that can fit in the receptacle 21 of the housing 20 of the board connector 10. Cavities 52 in the housing 51 define an array corresponding to the terminal connecting portions 12 of the terminal fittings 11 of the board connector 10. Female terminals 53 connected to ends of wires W are inserted into the cavities 52 from behind, and are locked primarily by locking lances 54 in the cavities 52 and secondarily by a retainer 55.

A lock lever 57 is provided at the upper surface of the housing 50 for resiliently locking a lock projection 25 of the housing 20 of the board connector 10.

Figure 10:
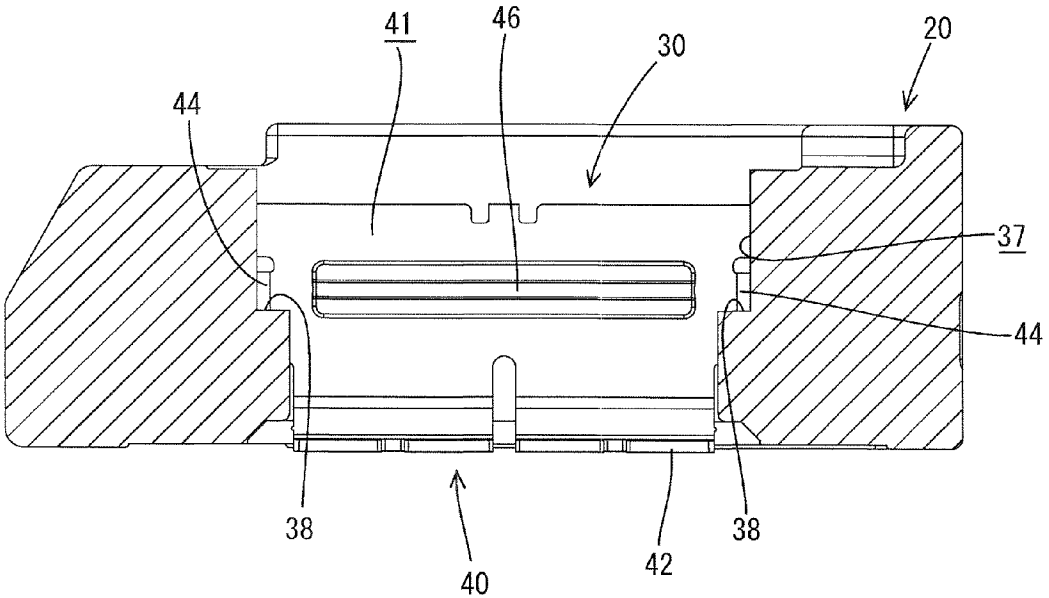
FIG. 10 is a section along B-B of FIG. 4 showing the state of FIG. 9.

The terminal fittings 11 are mounted into the housing 20 and the fixtures 40 are mounted into the respective mounting grooves 30 at the opposite side surfaces. More specifically, the fixtures 40 are inserted into the mounting grooves 30 from above and along the inserting direction ID, as shown by the arrow of FIG. 3, while the main plates 41 move along the side surfaces of the housing 20. The fixtures 40 are pushed while the first and second and first projecting locks 43, 45 on the left and right edges of the main plates 41 are press-fit into the upper and intermediate stages 32 and 33 of the back side grooves 31 and the bent locks 44 are inserted into the vertical grooves 37. The first and second projecting locks 43, 45 shown in FIG. 9 respectively contact the first and second receiving surfaces 35, 36 of the back side grooves 31 and the bent locks 44 contact the third receiving surfaces 38 of the vertical grooves 37, as shown in FIG. 10, when the mounting plates 42 are pushed to the positions slightly above the lower surface of the housing 20.

During this time, the biting projections 43A of the first projecting locks 43 and the biting projections 45A of the second projecting locks 45 bite into the groove bottoms of the upper stages 32 and the middle or intermediate stages 33 of the back side grooves 31, so that the fixtures 40 are retained and mounted in the mounting grooves 30.

Figure 11:
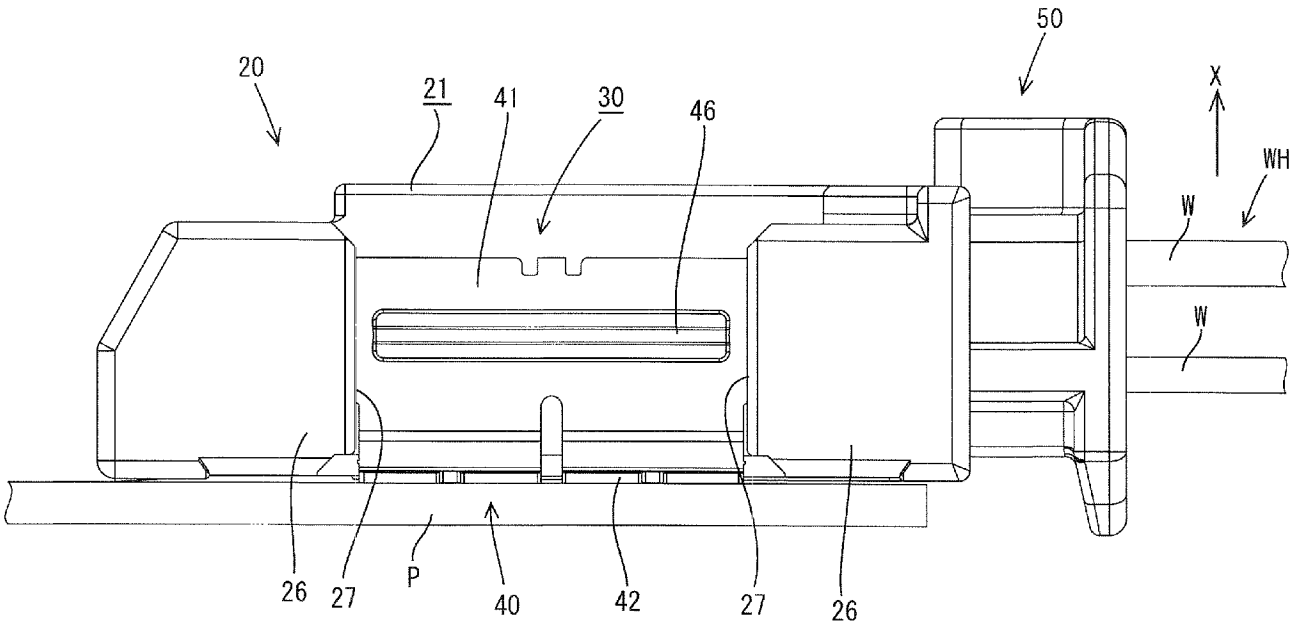
FIG. 11 is a side view showing a state where the harness-side connector is connected to the board connector.

The assembled board connector 10 is placed at a specified position on the board P so that the front end of the housing 20 projects a specified distance from the end edge of the board P, as shown in FIGS. 1 and 11. The board connecting portions 13 of the respective terminal fittings 11 then are connected electrically (e.g. soldered) to the corresponding conductive paths by surface mounting, and the mounting plates 42 of the left and right fixtures 40 are connected to the board P by soldering, bolting, gluing or the like.

The mating housing-side connector 50 is inserted into the receptacle 21 of the housing 20 of the board connector 10 mounted on the board P, as shown by an arrow of FIG. 1. The lock lever 57 engages with the lock projection 25 when the housing-side connector 50 is fit to a proper position so that the two connectors 10, 50 are locked in a properly connected state and, accordingly, the corresponding terminal fittings 11 and female terminals 53 are connected electrically to each other.

The wiring harness WH pulled out from the housing-side connector 50 may move vertically due to vibration or the like or may be pulled up as shown by an arrow X of FIG. 11 in a state where the two connectors 10, 50 are completely connected. Thus, a force acts to tear the front side of the housing 20 of the board connector 10 from the board P. In this case, the first, second and third receiving surfaces 35, 36 and 38 at the front side (right side in FIGS. 9 and 10) mainly formed in the mounting grooves 30 are engaged with the first and second projecting locks 43 and 45 and the bent locks 44 formed on the front edges of the fixing fixtures 40, thereby preventing the housing 20 from being torn.

The locks 43, 44 and 45 are arranged vertically one above another on each lateral edge of each fixture 40. Thus, a load when a force acts on the housing 20 in a direction to tear the housing 20 from the board P is distributed among the respective locks 43, 44 and 45. Therefore a locking function is assured by preventing deformation of the respective locks 43, 44 and 45 and ensuring sufficient engagement areas.

Further, in providing the plurality of (e.g. three) locks one above another, if all the locks are projecting, the fixtures 40 become wider and, accordingly, the width of the mounting grooves 30 and, therefore, the depth of the housing 20 need to be increased. On the contrary, in this embodiment, one lock 44 is bent. Thus, the width enlargement of the fixtures 40 can be suppressed and the width enlargement of the mounting grooves 30 and, therefore, the enlargement of the housing 20 can be suppressed. As a result, fixing strength of the board connector 10 to the board P can be improved without leading to the enlargement of the housing 20 and the like.

In a vertical arrangement relationship of the first projecting lock 43 and the bent lock 44, a clearance has to be provided between the outer surface of the bent lock and the groove bottom of the mount groove in some cases to ensure a sufficient engagement area of the first projecting lock with the receiving surface if the bent lock is above the first projecting lock. In this respect, in this embodiment, by arranging the first projecting lock 43 above the bent lock 44, a large engagement area of the first projecting lock 43 with the first receiving surface 35 can be ensured while the outer surface of the bent lock 44 is held in contact with the groove bottom of the vertical groove 37 so as not to shake.

Further, the rigidity of bent parts of the bent locks 44 is increased and, therefore, deformation of the bent locks 44 is prevented more reliably by forming the reinforcing bead 46 at the height position corresponding to the formation positions of the bent locks 44 on the main plate 41 of the fixing fixture 40.

The invention is not limited to the above described and illustrated embodiment. For example, the following embodiments are also included in the scope of the invention.

It is sufficient to provide at least one projecting lock and one bent lock.

In the case of vertically arranging the projecting lock and the bent lock one above the other, which of them is located above does not matter.

A means for fixing the fixing fixtures to the board is not limited to soldering illustrated in the above embodiment and may be another means such as screw mounting, gluing or the like.

The fixing fixtures may be made of a material different from metal but having sufficient rigidity such as composite materials or the like.

What is claimed is:

1. A board connector, comprising:

a housing into which a mating connector is to be fit, the housing having a bottom to be mounted on a board, a top opposite the bottom and side surfaces extending between the top and bottom;

at least one upwardly open mounting groove formed on at least one of the side surfaces of the housing; and at least one fixing fixture to be mounted into the mounting groove in an inserting direction extending from the top toward the bottom while a plate surface the fixture substantially moves along the side surface of the housing, the fixture having a distal end portion to be fixed to the board, wherein:

first and second projecting locks laterally project from a side edge of the plate surface substantially in a common plane with the plate surface and spaced apart along the inserting direction and at least one bent lock disposed between the first and second projecting locks with respect to the inserting direction and bent outward at a substantially right angle with respect to the plate surface, and the mounting groove includes first and second upwardly facing receiving surfaces that respectively contact the first and second projecting locks to prevent further insertion of the locks and a third upwardly facing receiving surface engaging the bent lock, the third receiving surface having a larger dimension than the first and second receiving surfaces in directions perpendicular to the side surface of the housing for further resisting upward forces on the housing.

2. The board connector of claim 1, wherein the at least one fixing fixture is made of a metal plate material.

3. The board connector of claim 1, further comprising at least one reinforcing bead on the fixing fixture.

4. The board connector of claim 3, wherein the reinforcing bead extends in a direction intersecting the inserting direction and is formed at a height position of the fixing fixture substantially corresponding to a formation position of the bent lock.

5. The board connector of claim 1, further comprising at least one mounting plate bent outward at a substantially right angle from a distal end portion of the plate surface of the fixing fixture and is to be fixed to the board by soldering.

6. A board connector, comprising:

a housing having a bottom to be mounted on a board, a top opposite the bottom and first and second opposite side surfaces, opposed front and rear walls bulging out from each of the side surfaces and front and rear mounting grooves formed respectively in the front and rear walls, the front and rear mounting grooves on each of the side surfaces being open in directions facing one another and being open upward, each of the mounting grooves having first, second and third upwardly facing receiving surfaces, the first receiving surface being closer to the top of the housing than the second or third receiving surfaces and the third receiving surface being closer to the bottom of the housing than the first and third receiving surfaces, the third receiving surfaces being wider than the first and second receiving surfaces in directions perpendicular to the side surfaces; and first and second fixing fixtures formed respectively with first and second main plates supported respectively on the first and second side surfaces of the housing, front and rear lower projecting locks projecting forward and rearward respectively from front and rear edges of the main plate, front and rear upper projecting locks projecting forward and rearward respectively from the front and rear edges of the main plate at positions above the lower projecting locks, the upper and lower projecting locks being engaged in the mounting grooves against the first and second receiving surfaces respectively, front and rear bent locks projecting respectively from the front and rear edges of the main plate at positions between the upper and lower projecting locks and aligned substantially perpendicular to the main plate, the bent locks being engaged against the third receiving surfaces.

* * * * *